US011285976B2

(12) United States Patent
Breuer et al.

(10) Patent No.: US 11,285,976 B2
(45) Date of Patent: Mar. 29, 2022

(54) METHOD FOR COMPENSATING FOR A LOSS OF TRACTION OF A RAIL VEHICLE

(71) Applicant: SIEMENS MOBILITY GMBH, Munich (DE)

(72) Inventors: Werner Breuer, Munich (DE); Hans Juergen Maerkl, Stadtbergen (DE); Wolfgang Rulka, Munich (DE); Martin Zaech, Freimann (DE)

(73) Assignee: Siemens Mobility GmbH, Munich (DE)

( * ) Notice: Subject to any disclaimer, the term of this patent is extended or adjusted under 35 U.S.C. 154(b) by 280 days.

(21) Appl. No.: 16/606,912

(22) PCT Filed: Jan. 8, 2018

(86) PCT No.: PCT/EP2018/050367
§ 371 (c)(1),
(2) Date: Oct. 21, 2019

(87) PCT Pub. No.: WO2018/192688
PCT Pub. Date: Oct. 25, 2018

(65) Prior Publication Data

US 2020/0239038 A1 Jul. 30, 2020

(30) Foreign Application Priority Data

Apr. 21, 2017 (DE) ..... 10 2017 206 757.8

(51) Int. Cl.
*B61F 5/38* (2006.01)
*B61C 15/14* (2006.01)
*B61F 3/04* (2006.01)

(52) U.S. Cl.
CPC ..... *B61C 15/14* (2013.01); *B61F 3/04* (2013.01); *B61F 5/386* (2013.01)

(58) Field of Classification Search
CPC ..... B61C 15/14; B61C 15/02; B61C 15/08; B61C 15/00; B61F 3/04; B61F 5/386; B61F 5/38; B60L 15/2036; B62D 9/00
USPC ..... 105/72.2
See application file for complete search history.

(56) References Cited

U.S. PATENT DOCUMENTS

| | | | | |
|---|---|---|---|---|
| 10,246,107 | B2 | 4/2019 | Meyer et al. | |
| 10,300,932 | B2 | 5/2019 | Meyer et al. | |
| 2005/0065701 | A1 | 3/2005 | Kumar et al. | |
| 2013/0319563 | A1* | 12/2013 | Brown | B60D 1/64 138/103 |

FOREIGN PATENT DOCUMENTS

| | | | |
|---|---|---|---|
| CN | 1845842 | A | 10/2006 |
| CN | 101007498 | A | 8/2007 |
| CN | 101596909 | A | 12/2009 |

(Continued)

*Primary Examiner* — Mark T Le
(74) *Attorney, Agent, or Firm* — Laurence A. Greenberg; Werner H. Stemer; Ralph E. Locher

(57) ABSTRACT

A method for compensating for a loss of traction of a rail vehicle, preferably a freight locomotive, in a track curve, is particularly pertinent when the rail vehicle is starting up and/or is on an incline. Comparably unfavorable frictional conditions between a track and at least one driven track wheel of the rail vehicle are changed into comparably favorable frictional conditions by actively steering the track wheel on the rail.

16 Claims, 5 Drawing Sheets

(56) References Cited

FOREIGN PATENT DOCUMENTS

| | | | | | |
|---|---|---|---|---|---|
| CN | 102501873 | A | | 6/2012 | |
| CN | 105365828 | A | | 3/2016 | |
| DE | 4424884 | A1 | | 1/1996 | |
| DE | 19910256 | A1 | | 9/2000 | |
| DE | 102006033029 | A1 | | 1/2008 | |
| DE | 102013224582 | A1 | | 6/2015 | |
| DE | 102014214055 | A1 | | 1/2016 | |
| EP | 1609691 | A1 | | 12/2005 | |
| EP | 2322402 | A1 | | 5/2011 | |
| FR | 2634439 | A1 | | 1/1990 | |
| GB | 2 344 326 | | * | 7/2000 | |
| KR | 20090059534 | A | * | 6/2009 | |
| RU | 2553401 | C1 | | 6/2015 | |
| RU | 167616 | U1 | | 1/2017 | |
| RU | 2606417 | C1 | | 1/2017 | |
| WO | 9000995 | A1 | | 2/1990 | |
| WO | WO-2009072692 | A1 | * | 6/2009 | ..... B61F 5/386 |
| WO | WO-2011078461 | A | * | 6/2011 | ..... B61F 5/386 |

* cited by examiner

METHOD FOR COMPENSATING FOR A LOSS OF TRACTION OF A RAIL VEHICLE

BACKGROUND OF THE INVENTION

Field of the Invention

The invention relates to a method for compensating for a loss of traction of a rail vehicle, preferably of a freight locomotive, in a track curve, in particular when the rail vehicle is starting up and/or in particular on an incline.

DE 10 2014 214 055 A1 discloses a running gear for a rail vehicle, having a running-gear frame supported at least on a first and a second wheelset, wherein, per wheelset, on both running-gear sides, a triangular link for horizontal axle guidance of the wheelset is set up, and each triangular link is connected in an articulated manner per track wheel by means of a wheelset-side bearing and is connected in an articulated manner to the running-gear frame by means of two frame-side bearings. At least one of the bearings of each triangular link has a hydraulic bushing with variable longitudinal stiffness, wherein the hydraulic bushing comprises at least one fluid chamber that is fillable with a hydraulic fluid, such that a hydraulic pressure, via which the longitudinal stiffness of the hydraulic bushing is settable, can build up in the fluid chamber.

Given unfavorable track conditions, for example soiled and/or wet rails, transmissible mechanical friction between a driven track wheel of a rail vehicle (railroad vehicle, traction unit, locomotive, power car, railcar, self-propelled special-purpose vehicle for railroad functions etc.) and a relevant rail may decrease drastically. A mechanical drive output provided by the rail vehicle can no longer be transmitted fully and drive control has to prevent the wheels spinning as a result of a reduction in traction (loss of traction).

In modern rail vehicles, the rail vehicle is started up with the drive of the rail vehicle in a slipping mode. In the slipping mode, a further loss of traction of around 10% is observed in rail vehicle deployment when the rail vehicle is located in a curve (bend) (loss of traction in the curve), and in particular when the rail vehicle starts up from a standstill in the curve. This loss of traction tends to increase with a decreasing bend radius. Furthermore, the transmissible mechanical friction can depend on the gradient of an incline.

In freight locomotives used in mountainous areas, i.e. used with a high traction requirement (high grip utilization), this additional loss of traction may be unacceptable in particular during start-up operations, for example a start-up at a stop signal in a curve, on an incline and/or with a soiled/wet track; the freight train can no longer start up in the worst case with unfavorable rail conditions. The loss of traction given unfavorable rail conditions is caused by reduced friction between a driven track wheel and the relevant rail (also known as reduced adhesion).

In order to counteract the loss of traction or to increase transmissible traction, the following possibilities already exist. A heavier locomotive can be used. It is also possible to distribute a normal force better on account of a constructive design of the locomotive, in order that a sum over all track wheels largely yields an optimum (key words: load shift, low articulation of the traction link, push/pull rod etc.). Furthermore, the friction ratios can be improved (rudimentary: sanding, drive control: cleaning and high slip for roughening a contact face of the track wheels).

SUMMARY OF THE INVENTION

It is an object of the invention to partially compensate for an additional loss of traction of a rail vehicle, in particular during start-up operations, in a curve, in order not to have to resort to alternatives such as the use of an actually oversized locomotive, sanding etc. Furthermore, according to the invention, rail wear, in particular wearing of a railhead, is intended to be taken into account.

The object of the invention is achieved by a method for compensating for a loss of traction of a rail vehicle, preferably of a freight locomotive, in a track curve, in particular when the rail vehicle is starting up and/or in particular on an incline, according to the independent claim. Advantageous developments, additional features and/or advantages of the invention will become apparent from the dependent claims and/or the following description of the invention.

In the compensation method according to the invention, comparatively unfavorable (i.e. poor) friction conditions between a rail of the track curve and at least one driven track wheel of the rail vehicle are changed into comparatively favorable (i.e. good) friction conditions by actively steering the track wheel on the rail. The driven track wheel can be a constituent part of at least one driven wheelset of the rail vehicle, wherein the comparatively unfavorable friction conditions between the track curve or track curves and the at least driven wheelset are changed into comparatively favorable friction conditions by actively steering the at least one wheelset on the track curve or track curves.

Comparatively favorable friction conditions can be understood to be a more favorable basic friction ratio, a more favorable contact geometry (depending on a contact point position) etc. (see also below). —A radial position of one or more axles of the rail vehicle does not in this case automatically result in an increase in traction, but rather in an improvement in a contact point position of the driven track wheel on the relevant track curve or an improvement in the contact point positions of the driven wheelset on the track curves (see also below). According to the invention, this results in a friction ratio that is more favorable overall.

When the compensation method is being carried out, the at least one track wheel, in particular the at least one wheelset, can be actively steered hydraulically, pneumatically, mechanically, electrically and/or electromechanically; can be adjusted axially and/or radially; and/or can be pivoted about a pivot center. In one embodiment, the at least one track wheel, in particular the at least one wheelset, can be actively steered such that a contact region between the at least one track wheel, in particular the at least one wheelset, and a relevant rail in the track curve lies in a region in which a comparatively favorable or more favorable basic friction ratio and/or a comparatively favorable or more favorable contact geometry are present.

When the compensation method is being carried out, the at least one track wheel, in particular the at least one wheelset, can be actively steered such that a friction coefficient in the contact region increases; the contact region is created on a running region of the relevant rail; the contact region travels in the direction of a transverse center of the relevant rail; the contact region is located substantially at a transverse center of the relevant rail; a lower surface pressure arises in the contact region; and/or the contact region is enlarged.

When the rail vehicle is being started up or traveling slowly, the at least one track wheel in an underradial position, in particular the at least one wheelset in an underradial position, can be articulated such that the rail vehicle is shifted radially outward at least to some extent. Depending on a cant, it is preferred here for a track rail running on on the inside of a curve to be moved outward by the active steering. In order to move outward, the wheel axles are articulated to be underradial.

When the rail vehicle is traveling or traveling at speed, the at least one track wheel in an overradial position, in particular the at least one wheelset in an overradial position, can be articulated such that the rail vehicle is shifted radially inward at least to some extent. These cases relate in particular to a banked and possibly tight track curve, wherein, according to the invention, the contact regions pass back into the running region of the track wheels on the rail. When traveling (at speed), i.e. with a track wheel running on on the outside of the curve, the wheel axles are articulated to be overradial, wherein the wheel axle then moves from the outside of the curve back to the rail center.

Insertion: Without a drive, a leading track wheel largely sets itself to be always underradial, since for example in a right-hand curve, running on takes place at the front left. On account of a conical profile of the track wheel, a rolling radius is then larger than on the inside of the curve, and since, because of a rigid wheel axle, the rotational speeds of the two track wheels are the same, the track wheel on the outside of the curve tends to be braked, i.e. the wheelset on the outside of the curve is pushed backwards. The situation is different in the case of a trailing wheel axle. Depending on whether there is wheel crabbing, i.e. the track wheel on the inside of the curve runs on, or, in relatively large curves, running on likewise takes place at the track wheel on the outside of the curve, either an overradial or an underradial setting arises. This is dependent on the curve radius, track cant, traveling speed, vehicle mass and calibration of the stiffnesses in an axial location.

When the compensation method is being carried out, the at least one track wheel, in particular the at least one wheelset, can be steered by at least one actuator between the running gear or the running-gear frame and the track wheel or the wheelset. By means of the actuator, the track wheel or the wheelset is rotatable or pivotable on the rail or the track. Furthermore, the at least one track wheel, in particular the at least one wheelset, can be steered by active hydraulics or by an active pneumatic cylinder. Furthermore, the at least one track wheel, in particular the at least one wheelset, can be steered by an active hydraulic bushing or an active hydraulic cylinder.

In order to determine a wheel angle relative to the track or to the rail in the track curve, a bend radius can be estimated via curve identification, and/or a setpoint angle for the at least one track wheel, in particular the at least one wheelset, relative to the track can be defined in advance by a simulation. In one embodiment of the invention, a drive of the rail vehicle can work in a slipping mode, and/or the at least one actuator can be connected in series or in parallel with a wheelset longitudinal guide.

The invention is explained in more detail in the following text on the basis of exemplary embodiments with reference to the appended schematic drawing, which is not true to scale. Sections, elements, parts, units, diagrams and/or components that have an identical, unequivocal or similar configuration and/or function are indicated by the same reference signs in the description of the figures (see below), the list of reference signs, the claims and in the figures of the drawing. A possible alternative, which is not explained in the description (description of the invention (see above), description of the figures), is not illustrated in the drawing and/or is non-exhaustive, a static and/or kinematic reversal, a combination etc. with respect to the exemplary embodiments of the invention or to a component, a diagram, a unit, a part, an element or a section thereof, can furthermore be gathered from the list of reference signs.

In the invention, a feature (section, element, part, unit, component, function, size etc.) can be configured in a positive manner, i.e. present, or in a negative manner, i.e. absent, wherein a negative feature is not explained explicitly as a feature when it is not important according to the invention that it is absent. A feature of this specification (description, list of reference signs, claims, drawing) can be applied not just in the specified manner but also in some other manner (isolation, combination, replacement, addition, individual use, omission etc.). In particular, it is possible, on the basis of a reference sign and a feature assigned thereto, or vice versa, in the description, the list of reference signs, the claims and/or the drawing, to replace, add or omit a feature in the claims and/or the description. Furthermore, it is possible, as a result, for a feature in a claim to be interpreted and/or specified in more detail.

The features of this specification are (in light of the (mostly unknown) prior art) also able to be interpreted as optional features; i.e. each feature can be understood to be an optional, arbitrary or preferred, i.e. non-mandatory, feature. Thus, separation of a feature, optionally including its peripherals, from an exemplary embodiment is possible, wherein this feature is then transferable to a generalized concept of the invention. The lack of a feature (negative feature) in an exemplary embodiment indicates that the feature is optional with respect to the invention. Furthermore, a specific term for a feature can also be understood to be a generic term for the feature (optionally further hierarchical breakdown into sub-genre, sector etc.), with the result that, for example taking an identical effect and/or equivalence into consideration, generalization of one feature or of this feature is possible. —In the figures, which are merely by way of example:

DESCRIPTION OF THE INVENTION

Figure 1:
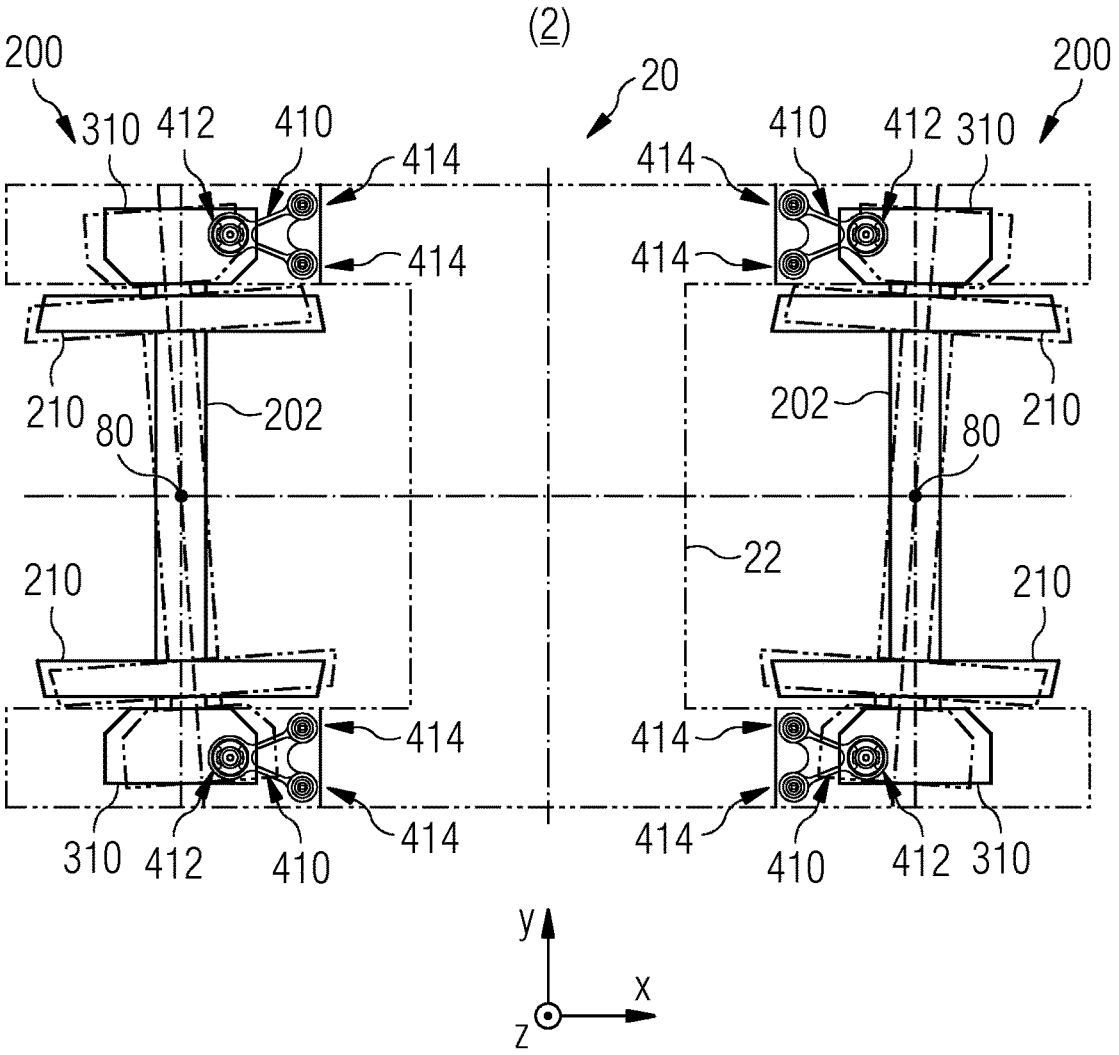
FIG. 1 shows a two-dimensional plan view of an exemplary embodiment of a two-axle running gear of a rail vehicle, having two wheelsets that are mounted in a running-gear frame via four triangular links, wherein a method according to the invention is able to be implemented by the triangular links.

The invention is explained in more detail in the following text on the basis of exemplary embodiments of a variant of a method according to the invention for compensating for a loss of traction of a rail vehicle 2, preferably of a freight locomotive 2, in a track curve 1, in particular when the rail vehicle 2 is starting up and/or in particular on an incline. However, the invention is not limited to such a variant, such embodiments and/or the exemplary embodiments explained in the following text, but is of a more basic nature, such that the invention can be applied to all methods for compensating for losses of traction of a rail vehicle.

In the drawing, only those sections of a subject of the invention are illustrated that are necessary for understanding the invention. Although the invention is illustrated and described in more detail by preferred exemplary embodiments, the invention is not limited by the disclosed exemplary embodiments. Other variations can be derived therefrom and/or from the above (description of the invention) without departing from the scope of protection of the invention.

s FIG. 1 shows a running gear 20 according to the invention of a rail vehicle 2, in particular of a freight locomotive 2, on which a body (not illustrated) of the rail vehicle 2 can be supported resiliently so as to be rotatable about a vertical axis (z). The running gear 20 has a running-gear frame 22, which is supported preferably on at least two wheelsets 200, 200 with respect to a track. Each wheelset 200, 200 has two track wheels 210, 210, which are connected together preferably mechanically rigidly by means of a wheel axle 202 mounted in two axle bearings 310, 310. For horizontally guiding (x, y) the wheelsets 200, 200, the latter are each articulated on the running-gear frame 22 on both body sides in each case by means of triangular links 410, 410.

In each case one of the four triangular links 410 is connected in an articulated manner to a single axle bearing 310 by means of a single wheelset-side bearing 412 of the triangular link 410, and to the running-gear frame 22 by means of two frame-side bearings 414, 414 of the triangular link 410. Each wheelset-side bearing 412 has for example a hydraulic bushing (cf. below) having preferably constant transverse stiffness (y) and preferably variable longitudinal stiffness (x). The two respective frame-side bearings 414, 414 have for example elastomeric bushings (cf. below) with preferably constant longitudinal stiffness (x) and preferably constant transverse stiffness (y).

The bearings 412, 414, 414 of each triangular link 410 are arranged at the "corners" of a horizontally (x, y) oriented, isosceles triangle, the tip portion of which forms the respective wheelset-side bearing 412 and the base portion of which forms the respective frame-side bearings 414, 414. When the rail vehicle 2 is traveling through a curve, at least one wheelset 200, preferably both wheelsets 200, 200, can be oriented radially or underradially (y) with respect to a track curve, this being indicated in FIG. 1 by a dot-dash line. This orientation of the two wheelsets 200, 200 can be brought about according to the invention by active steering.

In contrast to the two-axle running gear 20 illustrated in FIG. 1, a three-axle running gear (not illustrated) has a third wheelset 200, which is arranged in the longitudinal direction between the two wheelsets 200, 200 illustrated in FIG. 1 and is connected to the running-gear frame 22. When the rail vehicle 2 is traveling through a curve, at least one wheelset 200, preferably both outer wheelsets 200, 200, can be oriented radially or underradially (y) with respect to the track curve. This orientation of the two outer wheelsets 200, 200 can be brought about according to the invention by active steering.

In the event of unfavorable grip conditions between a driven track wheel 210 and a relevant rail 1, a transmissible traction decreases drastically compared with ideal conditions. Drive control of the rail vehicle 2 has to prevent spinning of the track wheels 210 by a reduction in drive traction. Furthermore, in modern rail vehicles 2, the rail vehicle 2 is driven with a controlled longitudinal slip between the driven track wheel 210 and the relevant rail 1. In this case, a further loss of traction of around 10% is observed when the rail vehicle 2 is located in a track curve and in particular when the rail vehicle 2 starts up in a track curve. This loss of traction tends to increase as the curve radius decreases. The gradient of an incline can further exacerbate this problem. This is of course transmissible to a wheelset 200 or the wheelsets 200, 200, . . . of the rail vehicle 2.

There are currently assumed to be mainly two causes of a loss of traction when the drive is in slipping mode. For one, a different "degree of soiling" (also: wetness) across the rail 1, or a different distribution of realizable friction over a rail cross section. In the contact regions 90 (cf. also FIG. 2) of the rail 1, which are frequently rolled over, other friction ratios are created than in regions that are contacted less often (in the worst case rusty region of the track curve 1). For the other, the friction is made up of a constant part and a part that is determined by surface pressure in the contact region 90 between the relevant track wheel 210 and the relevant rail 1. With increasing surface pressure, transmissible friction decreases with the contact region 90 remaining the same.

Both physical causes have an influence in particular on start-up operations of the rail vehicle 2 in the track curve. As a rule, the track curve is laid with a track cant at a rail 10 on the outside of the curve. During start-up operations, i.e. at a low speed or negative lateral acceleration, a relevant wheelset 200 slides or the relevant track wheels 210, 210 slide somewhat on a rail 10 on the inside of the track curve.

A contact region 90 between a relevant track wheel 210 or wheelset 200 and a relevant rail 10 of the track curve 1 travels from the running region (FIG. 2, left: straight section) in the direction of a flank (FIG. 2, right: curve) of the rail 10. A contact region 90, which is located closer to the relevant flank, is characterized by a smaller radius of curvature of a wheel cross-sectional portion and a smaller rail cross-sectional portion. This results in a smaller contact region 90 (FIG. 2, right) and, with a normal force remaining substantially the same, in a higher surface pressure. On account of an inclination of the entire rail vehicle 2 toward the inside of the curve, a normal force on the track wheel 210 on the inside of the curve is also increased, this further increasing the surface pressure.

Figure 3:
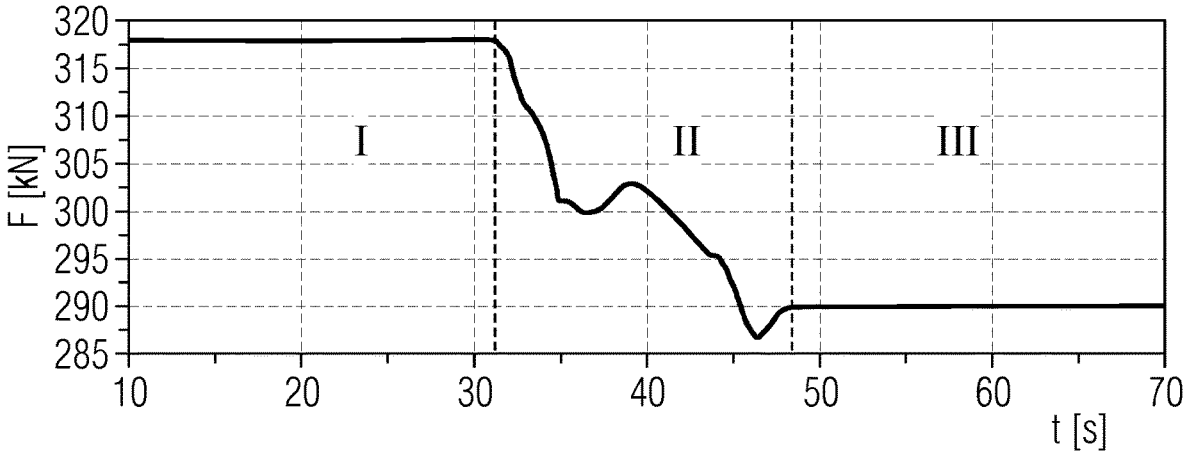
FIG. 3 shows a diagram of a simulation result of a loss of traction of a rail vehicle upon entering and traveling through a transition track curve (center) and upon entering a track curve (right) at a comparatively low speed of the rail vehicle with drive slip of the rail vehicle.

FIG. 3 shows a simulation result of a drive axle traction profile when a freight train driven by a rail vehicle 2 passes from a level straight section (I) into a level transitional track curve (II) and into a level 300 m track curve (III) at a speed of about 17 km/h (x-axis: travel time t of the rail vehicle 2 in [s], y-axis: sum of the tractions to be applied by the rail vehicle 2 in [kN]). The simulation result shows a loss of traction, as results when the geometry influence and surface-pressure influence explained above are taken as a basis.

In the illustrated scenario, the rail vehicle 2 initially starts rolling. After a few meters, the essentially maximum traction for the freight train has to be applied, wherein a friction coefficient is selected such that a maximum drive output of the rail vehicle 2 does not have to be transmitted, and the drive transitions into a slipping mode. A steady traction, to be applied by the rail vehicle 2, in the straight section (I) evens out at about 318 kN. Upon reaching the transitional track curve (II) after about 30 s travel time, a reduction in the friction starts, taking the geometry influence into account, wherein, in the 300 m track curve (III), only about 290 kN of steady traction can still be transmitted.

The simulation shows the loss of traction, observed during operation of the rail vehicle 2, of about 10%. A degree of soiling (also: wetness), present to a different extent over a rail cross section, of the track results, as second possible cause, in comparable results, when it is assumed that more soiling and thus less friction is achievable on the track wheels on account of the fewer instances of rolling-over (see above and FIG. 2, right). In other words, in a plane, an essentially maximum loss of traction of about 20% of a maximum drive output of the rail vehicle 2 should be expected.

The invention consists in compensating for the loss of traction of the rail vehicle 2 in the track curve preferably in slipping mode. In this case, at least one drivable track wheel 210, in particular at least one drivable wheelset 200, is actively steered such that a contact region 90 between the relevant track wheel 210 and the relevant rail 10 in a track curve 1 is once again in a range in which there are better basic friction ratios (comparatively high friction coefficient) and/or a more favorable contact geometry etc., i.e. favorable friction conditions. —In principle, two cases can be distinguished. These cases are in turn dependent on an actually traveled speed, a mass, a construction etc. of the rail vehicle 2; a curve radius, etc.

First, for example, when the rail vehicle 2 is being started up or traveling slowly in the banked and possibly tight track curve. In this case, for example both wheelsets 200, 200 of a truck of the rail vehicle 2 are in an underradial position relative to the track. Subsequently, the two wheelsets 200, 200 are articulated such that the two wheelsets 200, 200, or the truck, move somewhat upward from a rail edge located on the inside of the bend (cf. dot-dash line in FIG. 1). The contact regions 90 pass back into the running regions of the track wheels 210, 210 on the rails 10, or into the cross-sectional regions of the rails 10 that are rolled over more frequently, and likewise into regions in which a contact geometry with respect to surface pressure is consequently more favorable for the friction coefficient. Here, better friction ratios prevail, or a greater friction coefficient prevails than before.

When for example traveling (at speed) in the banked and possibly tight curve, this means that the two wheelsets 200, 200 of the truck are in an overradial position relative to the track. Subsequently, the two wheelsets 200, 200 are articulated such that the two wheelsets 200, 200, or the truck, move from a track edge located on the outside of the bend again somewhat toward the inside of the bend (cf. dot-dash line in FIG. 1). The contact regions 90 again pass into the running regions of the track wheels 210, 210 on the rails 10, or into the cross-sectional regions of the rails 10 that are rolled over more frequently. Here, a greater friction coefficient prevails than before. —The loss of traction can ideally be compensated almost completely.

Further positive secondary effects of the active steering of the at least one track wheel 210 or of the at least one wheelset 200 are mentioned (non-exhaustively) in the following text. According to the invention, a reduction in the quasi-static rail forces arises in the track curve. Merely as a result of the applied steering, which approaches improved setpoint angles with regard to the traction of the rail vehicle 2, a significant reduction in a rail shear force arises in all three traveling states of the rail vehicle 2 (driven in the (macro/micro) slipping mode, rolling). Furthermore, less rail wear arises with regard to head checks in the track curve. Head checks are rail defects in the railroad rail in the form of fine surface cracks. A further potential of the active steering is that, in the case of the rolling rail vehicle 2, of steering to setpoint positions of the track wheel 210 or wheelset 200 in the track, which represent good values in particular for rail wear.

Figure 4:
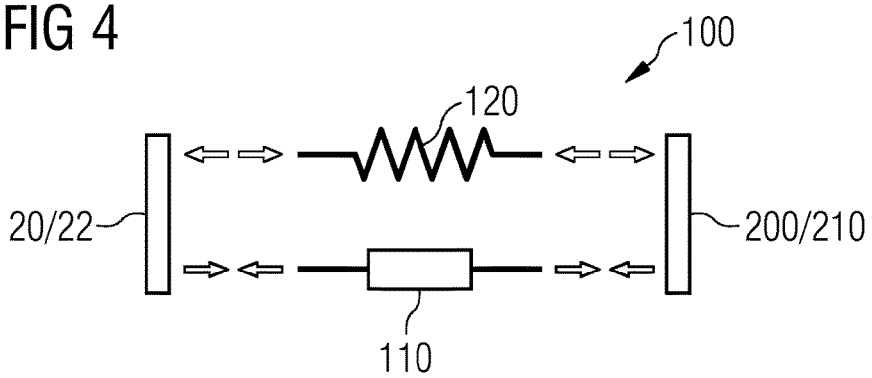
FIG. 4 shows a basic exemplary embodiment of an active link for actively steering an individual track wheel, an individual track wheel of a wheelset, or of a wheelset of a running gear or of a rail vehicle.

FIG. 4 shows a principle of such active steering for an individual track wheel 210 or an individual wheelset 200 with two track wheels 210. In this case, at least one actuator 100 is located between the running gear 20 or the running-gear frame 22 and the track wheel 210 or the wheelset 200. The or a relevant actuator 100 can be configured as a mechanical and/or electric (hydraulic, pneumatic, electromechanical, piezoelectric etc.) actuator 100. The actuator 100 can comprise an actuating element 110 and optionally a restoring element 120.

By means of the at least one actuator 100, the track wheel 210 or the wheelset 200 is rotatable or pivotable on the rail 10 or the track. According to the invention, the at least one drivable track wheel 210, or the at least one drivable wheelset 200, or preferably at least a plurality of drivable track wheels 210, or at least a plurality of drivable wheelsets 200, or in particular all the drivable track wheels 210, or all the drivable wheelsets 200, of the rail vehicle 2 are actively steered, i.e. actively rotated or pivoted as required.

Figure 2:
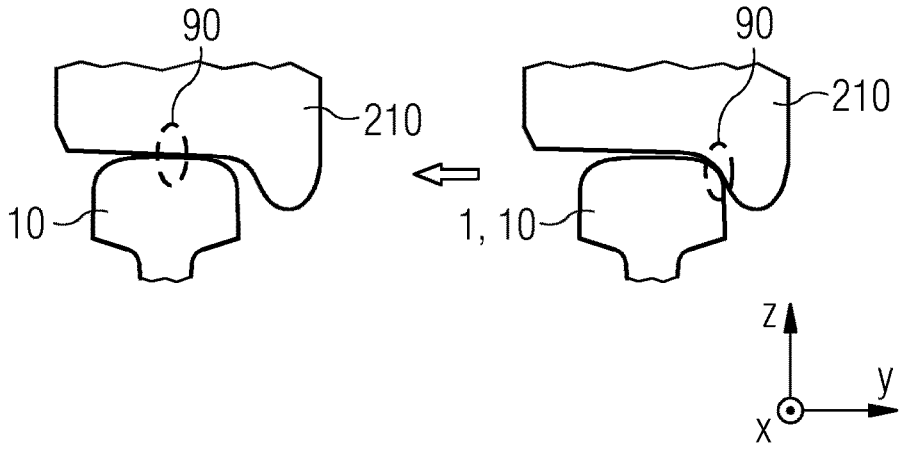
FIG. 2 shows two two-dimensional, cross-sectional views, each broken away at the top and bottom, of a rail and of a track wheel, wherein a contact region between the rail and the track wheel when traveling along a straight section is illustrated on the left and a contact region when traveling in a curve is illustrated on the right.

In this case, for example the relevant contact region 90 (cf. FIG. 2) between a track wheel 210, or a track wheel 210 of a wheelset 200, and a relevant rail 10 of the track curve 1 is displaced such that the contact region 90 travels from a flank (cf. FIG. 2, right) into (cf. FIG. 2, arrow) a running region (cf. FIG. 2, left). This takes place possibly while the rail vehicle 2 is moving forward or moving backward (traveling/approaching possibly an incline). In this case, the track wheel 210 or the wheelset 200 can be in an underradial position, overradial position, on a soiled rail 10 in a track curve 1 or a track.

Figure 5:
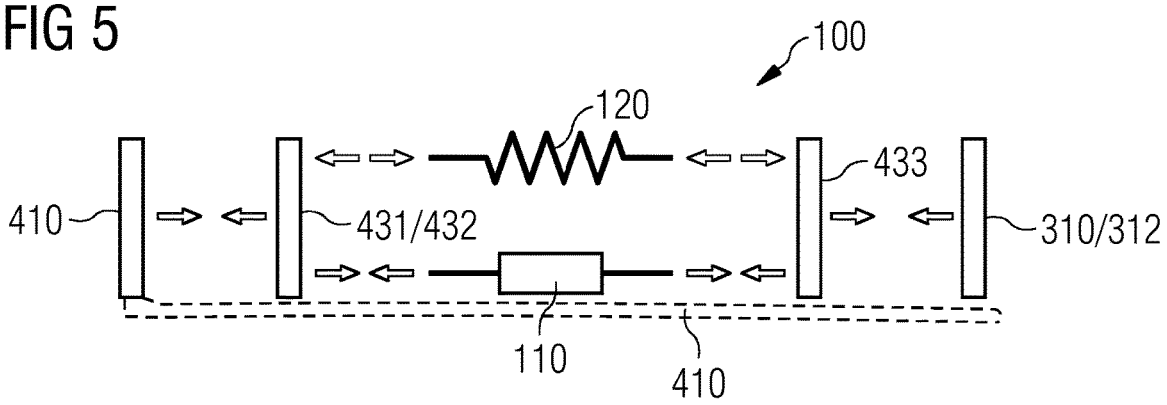
FIG. 5 shows a basic exemplary embodiment of an active axle guide bearing for actively steering an individual track wheel, an individual track wheel of a wheelset, or of a wheelset of a running gear or of a rail vehicle.

Active steering of an individual wheelset 200 (cf. FIG. 5) takes place preferably by means of two actuators 100, 100 (only a single actuator 100 is illustrated in FIG. 5) between a truck, a running gear 20 or a running-gear frame 22 and an individual wheelset 200. This can take place, in embodiments with high required steering forces or actuating forces, preferably by way of hydraulics, and in the case of comparatively lower required steering forces or actuating forces, by way of a pneumatic cylinder, optionally equipped with lever reinforcement (similarly to braking force cylinders). It is possible to use only a single actuator 100 in embodiments for this purpose.

An example thereof is an active hydraulic bushing 430, (100) (cf. FIGS. 6 and 7, and 8; actuating element 110, restoring element 120; or vice versa) or a passive hydraulic bushing 430 and an actuator 100 (cf. FIGS. 6 and 7, and 9; actuating element 110, restoring element 120; or vice versa). —In particular with regard to authorization, it is advantageous to connect an active actuator 100 (cf. active cylinder in FIG. 9) in parallel with a conventional wheelset longitudinal guide. A conventional passive wheelset longitudinal guide represents a "safe" fallback option for failure of an or the actuator(s) 100, 100. —The higher actuating forces, which push/press the wheelset 200 against a conventional bearing or pull/suck it away therefrom, remain manageably low, since a parallel circuit makes it possible to design the conventional bearings to be longitudinally softer.

To determine a wheel angle relative to the track, a direct angular measurement can be used, this being at least currently still time-consuming and costly. Furthermore, a bend radius can be estimated via curve identification (for example displacement angle measurement, lateral force measurement etc.). Furthermore, (essentially optimum) setpoint angles of the track wheels 210, 210 or of a wheelset 200 relative to the track can be defined in advance per simulation. In this way, setpoint displacements or setpoint forces of the actuators 100, 100 can be determined and/or defined in advance. These variables can either be applied in a controlled manner or can be measured easily via a position sensor or a pressure sensor and thus controlled.

Thus, it is possible, via the curve identification (displacement angle, lateral force measurement etc.), for the bend radius to be estimated. Furthermore, (essentially optimum) setpoint angles of the track wheels 210, 210 or of a wheelset 200 relative to the track can be defined in advance per simulation, with the result that, furthermore, there are (essentially optimum) angles of the track wheels 210, 210 or of a wheelset 200 relative to the truck, the running gear 20 or the running-gear frame 22. These can be converted either into setpoint displacements in the actuators 100, 100 or into setpoint actuator forces. These should either be applied in a controlled manner or can be measured easily in a constructive manner via pressure sensors and thus adjusted.

Figure 6:
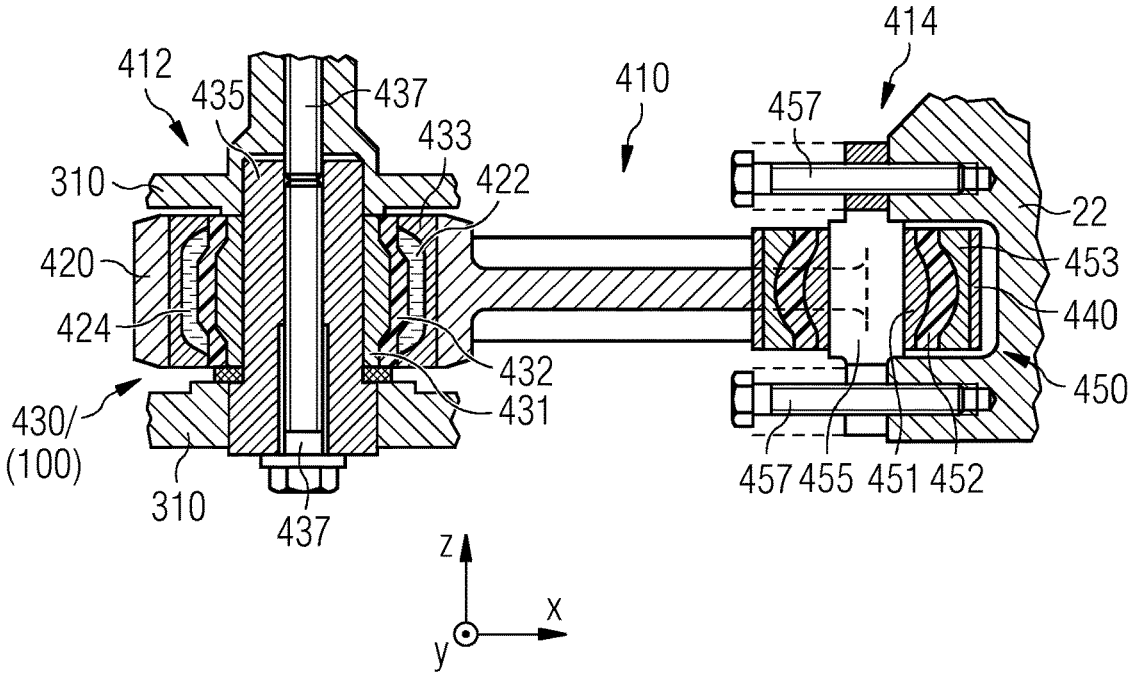
FIG. 6 shows a partially sectional, two-dimensional side view of a triangular link from FIG. 1, wherein the triangular link is illustrated in section in a broken-away manner centrally along its single wheelset-side bearing and along one of its two frame-side bearings and at its periphery (axle bearing and running-gear frame)
Figure 7:
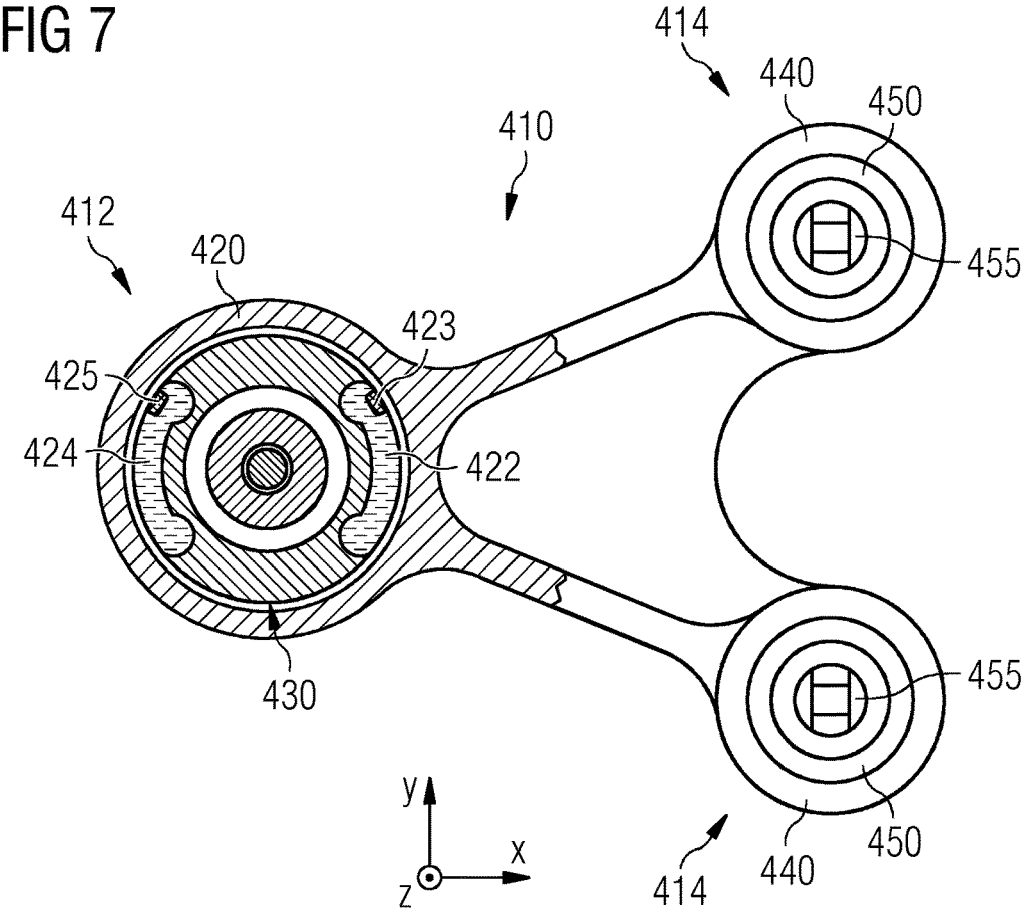
FIG. 7 shows a partially sectional, two-dimensional plan view of the triangular link from FIG. 6, wherein two fluid chambers that are set up in a manner separated fluid-mechanically from one another are illustrated in a partially cutaway manner in the wheelset-side bearing, illustrated in a simplified manner and configured as an axle guide bearing, of the triangular link.

According to FIGS. 6 and 7 (cf. also FIG. 1), for example a triangular link 410 has a link body, via connecting walls of which, which extend substantially horizontally, two preferably smaller link eyes 440, 440 for receiving elastomer bushings 450 are solidly connected to each other by a preferably larger link eye 420 for receiving a hydraulic bushing 430. The link body can be in the form of a cast part, a forged part or a milled part. At the two lateral edges, connecting the larger link eye 420 to the smaller link eyes 440, 440, of the connecting walls, substantially vertically protruding connecting bars are optionally integrally formed.

Each elastomer bushing 450 has an inner bearing shell 451, an outer bearing shell 453 and an elastomer ring 452 embedded therebetween. As a result of a rotationally symmetric structure of the elastomer bushing 450, the latter has a substantially constant stiffness in the longitudinal direction (x) and in the transverse direction (y). The respective outer bearing shell 453 fits in a relevant smaller link eye 440, while the inner bearing shell 451 has in each case a vertically oriented bearing pin 455 passing through it.

At the two ends, protruding out of an inner bearing shell 451, of the bearing pin 455, substantially planar, mutually parallel support surfaces have been cut out, in the region of which in each case one substantially horizontally extending through-hole is provided. The through-holes serve for the passage of fastening means 457 for connecting the respective frame-side bearing 414 to the running-gear frame 22 above and below the elastomer bushings 450.

The hydraulic bushing 430 has an inner bearing shell 431, an outer bearing shell 433 and an annular elastomer element 432 provided therebetween. The outer bearing shell 433 fits in the larger bearing eye 420, while the inner bearing shell 431 is passed through vertically by a bearing pin 435. The bearing pin 435 has a substantially vertically extending through-hole, via which fastening means 437 for connecting the wheelset-side bearing 412 to the axle bearing 310 are passed coaxially through the hydraulic bushing 430.

At mutually opposite sides in the longitudinal direction (x), the elastomer element 432 and the outer bearing shell 433 form between one another two segment-shaped, mutually separate cavities 422, 424. A partition wall of the cavities 422, 424 is not illustrated in the drawing. The cavity 422 facing the elastomer bushings 450 forms in this case an internal fluid chamber 422 and the cavity 422 facing away from the elastomer bushings 450 forms in this case an external fluid chamber 424 of the triangular link 410. The fluid chambers 422, 424 are filled with a hydraulic fluid.

The fluid chambers 422, 424 can be in fluidic communication with one another via an external or internal fluid channel (not illustrated), which acts as or has a fluid throttle. Furthermore, the internal fluid chamber 422 and the external fluid chamber 424 of a single hydraulic bushing 430 can be coupled hydraulically such that hydraulic fluid that flows out of one of the fluid chambers 422/424 on account of external pressurization, flows into the other fluid chamber 424/422. The external pressurization is caused by a guide force between the respective axle bearings 310 of a relevant wheelset 200 and the running-gear frame 22, which is transmitted by a respective triangular link 410 and can result in fluid exchange between the fluid chambers 422, 424 in the respective hydraulic bushing 430.

This fluid exchange can be further influenced, as is explained below. In this case, the external or internal fluid channel can be omitted. What is crucial for stiffness in the longitudinal direction (x) of a hydraulic bushing 430—assuming that there is no active influence on a fluid flow between the fluid chambers 422, 424 or with a fluid chamber 422, 424 of another hydraulic bushing 430 (see below)—is a frequency at which lateral acceleration from outside is excited in the elastomer element 432 as a result of hunting oscillation of the relevant wheelset 200. In addition to high transverse stiffness, the hydraulic bushing 430 has a variable, excitation-frequency-dependent longitudinal stiffness (x).

According to the invention, the fluid chambers 422, 424 of a single hydraulic bushing 430 can alternatively or additionally be in fluidic communication (not illustrated in FIG. 7) via external fluid lines, of which only the fluid ports 423, 425 are illustrated in FIG. 7. Furthermore, the fluid chambers 422, 424 of a single hydraulic bushing 430, of which only the fluid ports 423, 425 are illustrated in FIG. 7, can alternatively or additionally be in fluidic communication (not illustrated in FIG. 7) with at least one fluid chamber 422, 424 of another hydraulic bushing 430 via external fluid lines. An external fluid line can be configured for example as a rigid hydraulic line or a flexible hydraulic hose.

Thus, it is possible for the hydraulic bushings 430, 430 arranged on the same running-gear side (right or left) to be connected via two external fluid channels (not illustrated in FIG. 1, illustrated in interrupted fashion in FIG. 8) such that, per running-gear side, one external fluid chamber 424 of a first wheelset 200 is hydraulically coupled to an external fluid chamber 424 of a second wheelset 200 and an internal fluid chamber 422 of the first wheelset 200 is hydraulically coupled to an internal fluid chamber 422 of the second wheelset 200. Hydraulic coupling takes place preferably symmetrically to the longitudinal direction on both running-gear sides, with the result that radial positioning of in each case two wheelsets 200, 200 in the track curve is favored and a necessary high longitudinal stiffness when starting up with high traction or during braking is ensured.

When driving or when braking the wheelsets 200, 200, the wheelset-side bearings 412, 412, 412, 412 are subjected to forces in the same direction, such that no fluid exchange occurs between the coupled fluid chambers 422, 422; 424, 424; 422, 422; 424, 424—the wheelset-side bearings 412, 412, 412, 412 react strongly. When traveling through a curve, forces in the opposite directions arise, such that hydraulic fluid is exchanged between the respectively coupled fluid chambers 422, 422; 424, 424; 422, 424; 424, 424 and, on account of a weak bearing reaction, radial setting of the wheelsets 200, 200 occurs. The advantage resides in a good transmission of pulling/pushing forces.

Furthermore, it is possible that, per running-gear side, an external fluid chamber 424 of a first wheelset 200 is hydraulically coupled to an internal fluid chamber 422 of a second wheelset 200 and an internal fluid chamber 422 of the first wheelset 200 is hydraulically coupled to an external fluid chamber 424 of the second wheelset 200. Hydraulic coupling takes place again preferably symmetrically to the longitudinal direction on both running-gear sides.

In the descriptions given above, it is assumed that the hydraulic fluid only flows on account of wheelset guide forces into and out of the fluid chambers 422, 424; 422, 424; 422, 424; 422, 424. However, according to the invention, a flow behavior of the hydraulic fluid is actively influenced. This is described in more detail in the following text, and for this reason the fluid lines 522, 524; 522, 524 are illustrated in an interrupted manner in FIG. 8.

Figure 8:
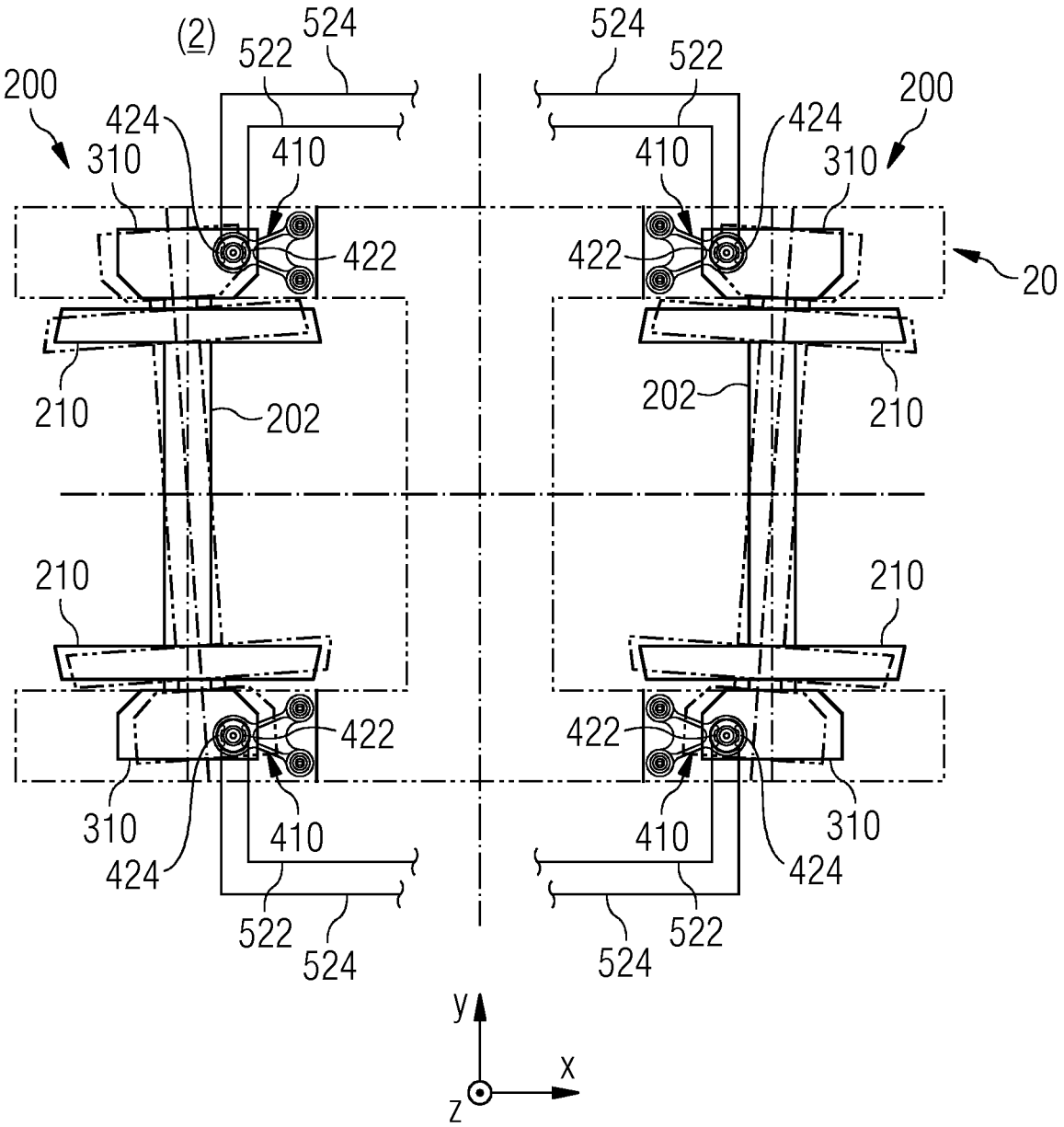
FIG. 8 shows a two-dimensional plan view of an exemplary embodiment of the running gear according to the invention from FIG. 1, wherein the eight fluid chambers of the four triangular links can be pressurized with a fluid pressure through fluid lines and in such a way a wheelset of the running gear or of the rail vehicle is actively steerable.

According to the invention, the fluid lines 522, 524; 522, 524 are connected to hydraulics (not illustrated), by means of which the pressure ratios in the fluid chambers 422, 424; 422, 424; 422, 424; 422, 424 can be actively influenced (active hydraulic bushing 430, (100) in FIG. 8). In this case, a hydraulic interconnection of the hydraulics can be set up such that the hydraulics passively allow the above features when the hydraulics do not influence the pressure ratios in the fluid chambers 422, 424; 422, 424; 422, 424; 422, 424. Furthermore, the hydraulics can be configured such that they can actively carry out these passive settings themselves.

Furthermore, the hydraulics are set up such that, given comparatively unfavorable friction conditions between the rail vehicle 2 and a track, comparatively unfavorable friction conditions between a rail 10 of a track curve 1 and a driven track wheel 210, . . . , or a track curve 1 or a track and a driven wheelset 200, . . . of the rail vehicle 2 are changed into comparatively favorable friction conditions (more favorable basic friction ratio and/or more favorable contact geometry and/or etc.) by active steering (see above) of the track wheel 210, . . . on the rail 10 or of the wheelset 200, . . . on the track.

Unfavorable friction conditions between the rail vehicle 2 and a track are for example an above-discussed loss of traction in the curve when starting up (for example wheelsets 200, . . . in an underradial position), when traveling slowly (for example wheelsets 200, . . . in an underradial position), or possibly when traveling at speed (for example wheelsets 200, . . . in an overradial position); soiled and/or wet rail(s); small or decreasing curve radius; and or gradient of an incline etc.

The following descriptions relate to an individual rail vehicle 2, an individual truck, an individual running gear 20, or an individual running-gear frame 22, or an individual wheelset 200. The hydraulics can for this purpose be set up such that they can set a hydraulic pressure in in each case one individual fluid chamber of a plurality or of all fluid chambers individually. Furthermore, the hydraulics can be set up such that they can set a hydraulic pressure to be substantially identical in each case in an even plurality of or in all fluid chambers.

In order that for example both wheelsets 200 of a truck are in good positions on a track for distributing traction, both wheelsets 200 of the truck should be actively steered. Interaction of the two wheelsets 200 can be "optimized" in advance by simulation. —What is analogous to the traction when the rail vehicle 2 is starting up or accelerating is a braking force during stopping or a negative acceleration, i.e. an influence on a shorter braking path. In other words, the invention can be applied analogously to compensating for a loss of braking force of the rail vehicle 2.

The incline of the track, or of the relevant rail, for example in a mountainous area, has secondary effects on the loss of traction. In other words, in particular in the case of a high gradient, a particularly large amount of traction is necessary in order to keep a travel speed of the rail vehicle 2 constant or to even be able to start up in the first place. On flat land, in particular in Australia, a traction requirement comes from particularly long freight trains. The loss of traction in a curve is governed by the contact geometry, the friction distribution etc. (friction conditions) over a rail/wheel cross section, however.

Figure 9:
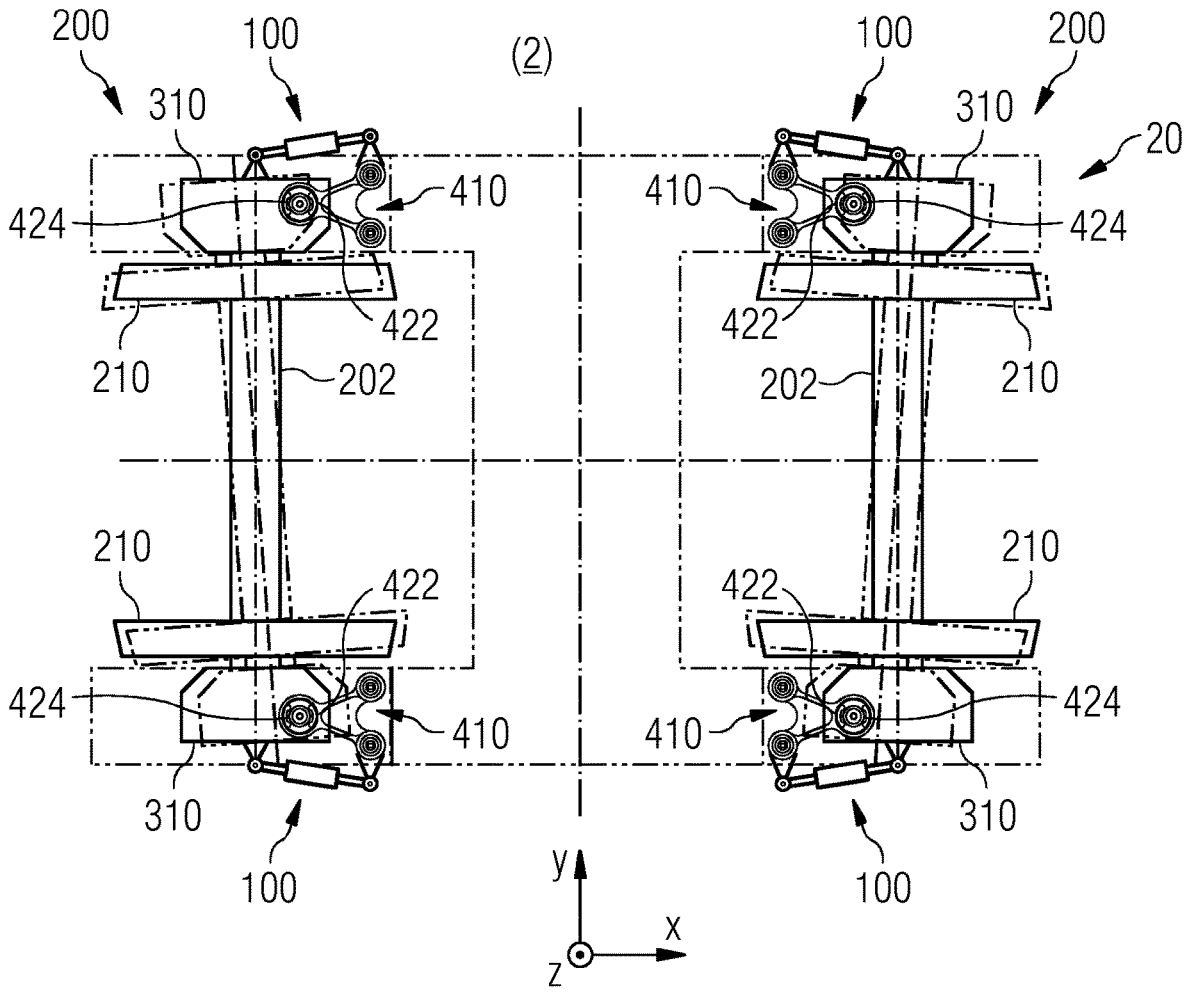
FIG. 9 shows a two-dimensional plan view of an exemplary embodiment of the running gear according to the invention from FIG. 1, wherein a respective triangular link is actuable by an actuator arranged parallel thereto and in such a way a wheelset of the running gear or of the rail vehicle is actively steerable.

Another possible way of realizing the above is shown in FIG. 9. In this case, active steering of the track wheel 210 takes place by means of a passive hydraulic bushing 430 (cf. the explanations given for FIGS. 6 and 7) and of an actuator 100, which is connected mechanically in parallel with the respective triangular link 410. In this case, the two fluid chambers 422, 424 of the passive hydraulic bushing 430 are in fluidic communication with one another via the external or internal fluid channel (not illustrated), which acts as or has a fluid throttle. The actuator 100 can be configured as an active cylinder 100, in particular a hydraulic cylinder 100. Another type of actuator 100 is of course usable here.

In this case, it is preferred for the actuator 100 to be configured in a longitudinally variable manner, wherein a longitudinal end portion of the actuator 100 is mechanically coupled directly or indirectly to the large link eye 420 of the triangular link 410 and an opposite longitudinal end portion of the actuator 100 is mechanically coupled directly or indirectly to the small link eye 440 of the triangular link 410. In other words, the actuator 100 can be directly fastened not only to the triangular link 410 itself but also, for example on one side of the large eye 420, to the axle bearing 310 or axle-bearing housing 312 and/or be directly fastened, on another side of the small eye 440, to the running gear 20 or running-gear frame 22.

Depending on a change in length of the actuator 100, hydraulic fluid flows out of one of the fluid chambers 422, 424 and into the other fluid chamber 424/422. For active steering, the actuators 100, 100 of an individual wheelset 200 are preferably actuated or controlled such that one actuator 100 lengthens, while the other actuator 100 shortens. It may possibly be advantageous to lengthen or to shorten both actuators 100, 100 of an individual wheelset 200.

The invention claimed is:

1. A method for compensating for a loss of traction of a rail vehicle, the method comprising:

changing comparatively unfavorable friction conditions between a rail and at least one driven track wheel of the rail vehicle into comparatively favorable friction conditions by actively steering the at least one track wheel of the rail vehicle on the rail so as to increase friction between the at least one track wheel and the rail.

2. The compensation method according to claim 1, wherein the rail vehicle is a freight locomotive.

3. The compensation method according to claim 1, which comprises performing the changing step while starting up the rail vehicle or while driving the rail vehicle on an incline.

4. The compensation method according to claim 1, which comprises effecting the changing step in a track curve of the track.

5. The compensation method according to claim 4, wherein:

the driven track wheel is a constituent part of at least one driven wheelset of the rail vehicle; and the step of changing the comparatively unfavorable friction conditions between the track curve and the at least one driven wheelset into comparatively favorable friction conditions comprises actively steering the at least one wheelset on the track curve.

6. The compensation method according to claim 5, which comprises compensating by subjecting the at least one wheelset to at least one of the following:

actively steering hydraulically, pneumatically, mechanically, electrically, and/or electromechanically;

adjusted axially and/or radially; and/or pivoting about a pivot center.

7. The compensation method according to claim 1, which comprises compensating by subjecting the at least one track wheel to at least one of the following:

actively steering hydraulically, pneumatically, mechanically, electrically, and/or electromechanically;

adjusted axially and/or radially; and/or pivoting about a pivot center.

8. The compensation method according to claim 1, which comprises actively steering the at least one track wheel, or a wheelset containing the at least one track wheel, such that:

a contact region between the at least one track wheel or the wheelset and a relevant rail in the track curve lies in a region in which a more favorable basic friction ratio and/or a more favorable contact geometry are present.

9. The compensation method according to claim 1, which comprises compensating by actively steering the at least one track wheel, or at least one wheelset containing the at least one track wheel, such that at least one of the following is true:

a friction coefficient in the contact region increases;

a contact region is created on a running region of the relevant rail;

the contact region travels in a direction of a transverse center of the relevant rail;

the contact region is located substantially at a transverse center of the relevant rail;

a lower surface pressure arises in the contact region; and/or the contact region is enlarged.

10. The compensation method according to claim 1, which comprises:

when the rail vehicle is being started up or is traveling slowly, articulating the at least one track wheel in an underradial position, or at least one wheelset containing the at least one wheel in an underradial position, in order to shift the rail vehicle radially outward at least to some extent; and/or when the rail vehicle is traveling or traveling at speed, articulating the at least one track wheel in an overradial position, or at least one wheelset containing the at least one wheel in an overradial position, in order to shift the rail vehicle radially inward at least to some extent.

11. The compensation method according to claim 1, which comprises steering the at least one track wheel, or at least one wheelset containing the at least one track wheel:

by way of at least one actuator disposed between a running gear or a running-gear frame and the at least one track wheel or a wheelset containing the at least one track wheel;

by way of active hydraulics or by an active pneumatic cylinder; or by way of an active hydraulic bushing or an active hydraulic cylinder.

12. The compensation method according to claim 1, which comprises, in order to determine a wheel angle relative to the track or to a rail in a track curve, estimating a bend radius via curve identification.

13. The compensation method according to claim 1, which comprises, in order to determine a wheel angle relative to the track or to a rail in a track curve, determining, in advance by simulation, a setpoint angle relative to the track for the at least one track wheel or at least one wheelset containing the at least one track wheel.

14. The compensation method according to claim 1, which comprises working a drive of the rail vehicle in a slipping mode.

15. The compensation method according to claim 1, wherein at least one actuator for steering the at least one track wheel, or at least one wheelset containing the at least one track wheel, is connected in series or in parallel with a wheelset longitudinal guide.

16. The compensation method according to claim 1, which comprises implementing the compensation method while the rail vehicle is moving forward or moving backward, and/or the compensation method is applied analogously to compensating for a loss of a braking force of the rail vehicle.

* * * * *